US009883702B2

(12) United States Patent
Martinet et al.

(10) Patent No.: US 9,883,702 B2
(45) Date of Patent: Feb. 6, 2018

(54) PORTION OF BRA AND BRA HAVING ZONES OF VARYING ELASTIC MODULI

(71) Applicant: Mast Industries (Far East) Limited, Kowloon Bay, Kowloon (HK)

(72) Inventors: Nathalie Martinet, Saikung (HK); Suet Hing Yip, Festival (HK); Queenie Jui-Chuan Lee, Lantau Island (HK); Nadeekha Michelle Leanage, Kotte (LK)

(73) Assignee: Mast Industries (Far East) Limited, Kowloon (HK)

( * ) Notice: Subject to any disclaimer, the term of this patent is extended or adjusted under 35 U.S.C. 154(b) by 250 days.

(21) Appl. No.: 14/877,444

(22) Filed: Oct. 7, 2015

(65) Prior Publication Data

US 2017/0099884 A1 Apr. 13, 2017

(51) Int. Cl.
*A41C 3/12* (2006.01)

(52) U.S. Cl.
CPC ..... *A41C 3/12* (2013.01)

(58) Field of Classification Search
CPC .... A41C 3/12; A41C 1/00; A41C 3/00; A41C 3/0065; A41C 5/005; A61F 13/51113
USPC ..... 450/19–21, 34, 53, 66, 65, 68, 92, 93, 450/74–76
See application file for complete search history.

(56) References Cited

U.S. PATENT DOCUMENTS 2,524,620 A 10/1950 Cadous
6,180,178 B1 * 1/2001 Vogt ..... A41C 3/0014 128/101.1
6,401,497 B1 * 6/2002 Nishiyama ..... A41B 9/04 66/171
6,509,094 B1 * 1/2003 Shah ..... A61M 25/0009 427/372.2
7,202,322 B2 4/2007 Vedula et al.
7,636,950 B2 12/2009 Melhart et al.
(Continued)

FOREIGN PATENT DOCUMENTS

CN 1131677 C 12/2003
CN 202112325 U 1/2012
(Continued)

OTHER PUBLICATIONS

European Search Report issued in EP16173597.2, dated Feb. 9, 2017.
(Continued)

*Primary Examiner* — Gloria Hale
(74) *Attorney, Agent, or Firm* — Andrus Intellectual Property Law, LLP

(57) ABSTRACT

A portion of a bra, such as a bra wing or bra cup, includes a double-faced fabric made with a polyurethane-based elastomer yarn. A silicone pattern is printed on a first face of the fabric, and at least partially penetrates the first face. In a first zone on the first face of the fabric, the printed silicone pattern has a first surface density, and in a second zone it has a second surface density. The first surface density imparts a first elastic modulus to the fabric in the first zone, while the second surface density imparts a second elastic modulus to the fabric in the second zone that is different than the first elastic modulus. A plurality of zones can be provided in order to provide a smoothing and/or support effect to the portion of the bra.

16 Claims, 2 Drawing Sheets

(56) References Cited

U.S. PATENT DOCUMENTS

| | | | | |
|---|---|---|---|---|
| 7,763,351 | B2 | 7/2010 | Vedula et al. | |
| 7,799,255 | B2 | 9/2010 | Vedula et al. | |
| 8,480,452 | B2 | 7/2013 | Reinisch et al. | |
| 8,601,613 | B2 | 12/2013 | Melhart et al. | |
| 9,468,241 | B2 | 10/2016 | Harber et al. | |
| 2004/0015187 | A1* | 1/2004 | Lendlein | A61B 17/06166 606/228 |
| 2004/0092696 | A1 | 5/2004 | Vedula et al. | |
| 2004/0266301 | A1 | 12/2004 | Vedula et al. | |
| 2006/0154053 | A1 | 7/2006 | Cain et al. | |
| 2006/0183849 | A1* | 8/2006 | Liu | C08G 18/0823 524/589 |
| 2007/0082579 | A1 | 4/2007 | Baran et al. | |
| 2007/0226870 | A1* | 10/2007 | Abbott | A41C 3/0014 2/69 |
| 2007/0238392 | A1 | 10/2007 | Starbuck et al. | |
| 2007/0239212 | A1* | 10/2007 | Schneider | A43B 1/0045 607/2 |
| 2007/0264462 | A1* | 11/2007 | Covelli | B32B 5/22 428/43 |
| 2008/0268748 | A1* | 10/2008 | Huang | A41C 3/0014 450/39 |
| 2009/0053441 | A1 | 2/2009 | Cain et al. | |
| 2009/0092807 | A1* | 4/2009 | Hu | B29C 61/003 428/215 |
| 2009/0181599 | A1* | 7/2009 | Farmer | A41B 17/00 450/39 |
| 2009/0271914 | A1 | 11/2009 | Bauer | |
| 2010/0124869 | A1* | 5/2010 | Liu | A41C 5/005 450/39 |
| 2010/0173119 | A1 | 7/2010 | Vitarana et al. | |
| 2010/0248575 | A1 | 9/2010 | Malz | |
| 2010/0325782 | A1 | 12/2010 | Vedula et al. | |
| 2011/0083246 | A1 | 4/2011 | Vitarana | |
| 2011/0111673 | A1* | 5/2011 | Soeda | D04B 1/18 450/1 |
| 2011/0143633 | A1 | 6/2011 | Zhang | |
| 2011/0282022 | A1* | 11/2011 | Tong | B29C 61/003 526/279 |
| 2013/0066288 | A1* | 3/2013 | Lin | A61F 13/51113 604/360 |
| 2015/0111466 | A1 | 4/2015 | Martinet et al. | |
| 2015/0351474 | A1* | 12/2015 | Farmer | A41D 31/02 2/67 |
| 2016/0057529 | A1* | 2/2016 | Kappus | H04R 1/1075 381/74 |
| 2016/0201734 | A1* | 7/2016 | Berndt | F16D 3/12 192/66.3 |
| 2017/0000195 | A1 | 1/2017 | Harber et al. | |
| 2017/0172219 | A1* | 6/2017 | Liao | A41C 1/003 |
| 2017/0226691 | A1* | 8/2017 | Farmer | D06M 15/564 |

FOREIGN PATENT DOCUMENTS

| | | | |
|---|---|---|---|
| CN | 104856248 | A | 8/2015 |
| CN | 205624537 | U | 10/2016 |
| DE | 19942996 | B4 | 3/2006 |
| EP | 0592668 | A1 | 4/1994 |
| EP | 1591574 | A1 | 11/2005 |
| GB | 2305870 | A | 4/1997 |
| GB | 2399519 | A | 9/2004 |
| JP | 2005089904 | A | 4/2004 |
| KR | 200439066 | Y1 | 3/2008 |
| WO | 1989008553 | A1 | 9/1989 |
| WO | 1999046118 | A1 | 9/1999 |
| WO | 2001056710 | A1 | 8/2001 |
| WO | 2005005697 | A1 | 1/2005 |
| WO | 2008055860 | A2 | 5/2008 |
| WO | 2009055361 | A1 | 4/2009 |
| WO | 2009084079 | A1 | 7/2009 |
| WO | 2010151633 | A1 | 12/2010 |
| WO | 2014049390 | A1 | 4/2014 |
| WO | 2014127291 | A2 | 8/2014 |
| WO | 2014199278 | A1 | 12/2014 |

OTHER PUBLICATIONS

Stretchline, Stay4Sure, http://www.stretchline.com/stay4sure.html, web site visited on Sep. 26, 2013.

Wacoal, Fibre-J Lace Bra, http://www.wacoal.com.sg/product-detail.php?prdid=76&page=2&category=1&search=38,40,42,81, web site visited on Oct. 3, 2014.

Wacoal, Sensual Comfort with Fiber-J, http://www.wacoal.com.sg/news.php?n=5, published Sep. 27, 2013, web site visited on Oct. 3, 2014.

Comfit, Back Smoothing Bra, http://www.comfit.com.cn/#/zh-cn/unit87, web site visited on Jun. 24, 2015.

Soma, Vanishing Back Collection Full Coverage Bra, http://www.soma.com/store/product/vanishing%ADback%ADfull %ADcoverage%ADbra/570007270?color=719&catId=cat5969283&fromSearch=true&scPos=1-676-1186, web site visited on Jun. 24, 2015.

Vanity Fair, Women's Beauty Back Smoother Full Figure Underwire Bra, http://shop.vanityfairlingerie.com/VanityFairWomensSmootherUnderwire/dp/B003DTMPS0, web site visited on Jun. 24, 2015.

Wacoal, Amazing Assets Back Smoothing T-Shirt Bra, http://www.wacoal-america.com/amazing-assets-back-smoothing-t-shirt-bra-wacoal-853220-p.html, web site visited on Jun. 24, 2015.

Warner's, Back to Smooth Underwire Back Smoother Bra 1575, http://www1.macys.com/shop/product/warners-back-to-smooth-underwire-back-smoother-bra-1575?ID=760976, web site visited Jun. 24, 2015.

Office Action issued in corresponding Chinese Application No. 201610232721.4, dated Nov. 1, 2017.

* cited by examiner

PORTION OF BRA AND BRA HAVING ZONES OF VARYING ELASTIC MODULI

FIELD

The present disclosure relates to the field of undergarments, and more specifically to garments such as bras.

BACKGROUND

DE Patent No. 19942996, assigned to NTT New Textile Technologies GmbH, discloses that to produce an underwear garment, at least zones of a single-layer fabric are coated on one side with an adhesive to bond an applied flocking. The adhesive is applied at local points or in lines, or it covers the whole surface of each zone. The zones for the adhesive coating are at areas of the underwear where there is a particular requirement for support and shaping, to give a flocked surface against the skin of the wearer. A stencil is placed over the garment fabric, and the adhesive is sprayed at the stencil openings, to coat the fabric surface in the required application pattern. The adhesive can also be applied by an ink jet printer. The flocking is applied to the damp adhesive mass from a flocking container, with an electrostatic field between the container and the fabric so that the flocking lies against the adhesive to be bonded by it. An electrically conductive plate is under the fabric, connected to one pole of the voltage supply, and the flocking container is connected to the other pole. The carrier fabric is knitted or woven of natural, synthetic or semi-synthetic materials. The flocking is of natural, synthetic or semi-synthetic fibers, yarn sweepings or dust and/or relatively large flocks. The flocking can be in a different color from the garment fabric.

U.S. Patent Application Publication No. 2009/0271914, assigned to NTT New Textile Technologies GmbH, discloses a garment including support bands fabricated from an elastomeric adhesive and flocking with one end of the flocking fibers embedded within the elastomeric adhesive. In addition, a process for producing garments with flocking fibers manufactured using electrostatic or mechanical devices is disclosed.

U.S. Patent Application Publication No. 2010/0173119, assigned to NTT New Textile Technologies GmbH, discloses a narrow fabric including an elastomeric coating on at least a portion of at least one side of the narrow fabric to provide designed, localized control and performance in the narrow fabric. Optionally, the elastomeric coating may be embedded with flock fibers.

U.S. Patent Application Publication No. 2011/0083246, assigned to MAS Research & Innovation (Private) Limited, discloses a garment including a fabric and an elastomeric coating on at least a portion of at least one side of the fabric to provide designed, localized stretch and support to the garment, wherein the elastomeric coating is located where reduced stretch of the garment is desired. Garments having structures to facilitate cooling and heating are also described.

U.S. Patent Application Publication No. 2015/0111466, assigned to Mast Industries (Far East) Limited, discloses a bra including a pair of bra cups, each bra cup in the pair having an inner edge and an outer edge, the inner edges configured to be coupled to one another. The bra includes a pair of bra wings, each bra wing in the pair having a first end and a second end, each first end being coupled to an outer edge of each bra cup, respectively, and the second ends configured to be coupled to one another. At least one of the pair of bra cups and the pair of bra wings comprises a layer of fabric having intrinsically sticky fibers. The layer of fabric having intrinsically sticky fibers comprises an inner layer of the pair of bra cups and/or the pair of bra wings and contacts a wearer's skin while the bra is being worn, causing the bra to cling to the wearer's skin.

PCT Application Publication WO2014/049390, assigned to MAS Research & Innovation (Private) Limited, discloses a textile assembly comprising a textile substrate, a fabric, or a garment made out of the textile substrate or the fabric comprising an elastomeric coating with air and water vapor permeability. An elastomeric material with predetermined viscosity is applied onto at least a portion and at least one side of the textile substrate, the fabric, or the garment made out of textile substrate to provide designed localized elastic modulus enhancements. The elastomeric coating is embedded within the textile substrate interior, providing excellent handle, hand feel and drapability, low friction, and possibility of reshaping with appropriate molding conditions.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example, a portion of a bra includes a double-faced fabric made with a polyurethane-based elastomer yarn. A silicone pattern is printed on a first face of the fabric and at least partially penetrates the first face of the fabric on which it is printed. In a first zone on the first face of the fabric, the printed silicone pattern has a first surface density, while in a second zone on the first face of the fabric, the silicone pattern has a second surface density that is different than the first surface density. The first surface density of the printed silicone pattern imparts a first elastic modulus to the fabric in the first zone, and the second surface density of the printed silicone pattern imparts a second elastic modulus to the fabric in the second zone that is different than the first elastic modulus.

According to another example of the present disclosure, a bra includes a bra wing made of a double-faced fabric. A silicone pattern is printed on a first face of the fabric. The printed silicone pattern at least partially penetrates the first face of the fabric on which it is printed. In a first zone on the first face of the fabric, the printed silicone pattern has a first surface density, and at least a part of the first zone is proximate a lower edge of the bra wing. In a second zone on the first face of the fabric, the printed silicone pattern has a second surface density that is different than the first surface density. The second zone shares a border with the first zone and is proximate a lower middle area of the bra wing. The first surface density of the printed silicone pattern imparts a first elastic modulus to the fabric of the bra wing in the first zone. The second surface density of the printed silicone pattern imparts a second elastic modulus to the fabric of the bra wing in the second zone that is different than the first elastic modulus.

BRIEF DESCRIPTION OF THE DRAWINGS

Examples of articles of manufacture such as bras, portions of bras, and materials that can be used to construct bras are described with reference to the following figures. The same numbers are used throughout the figures to reference like features and like components.

DETAILED DESCRIPTION

Figure 1:
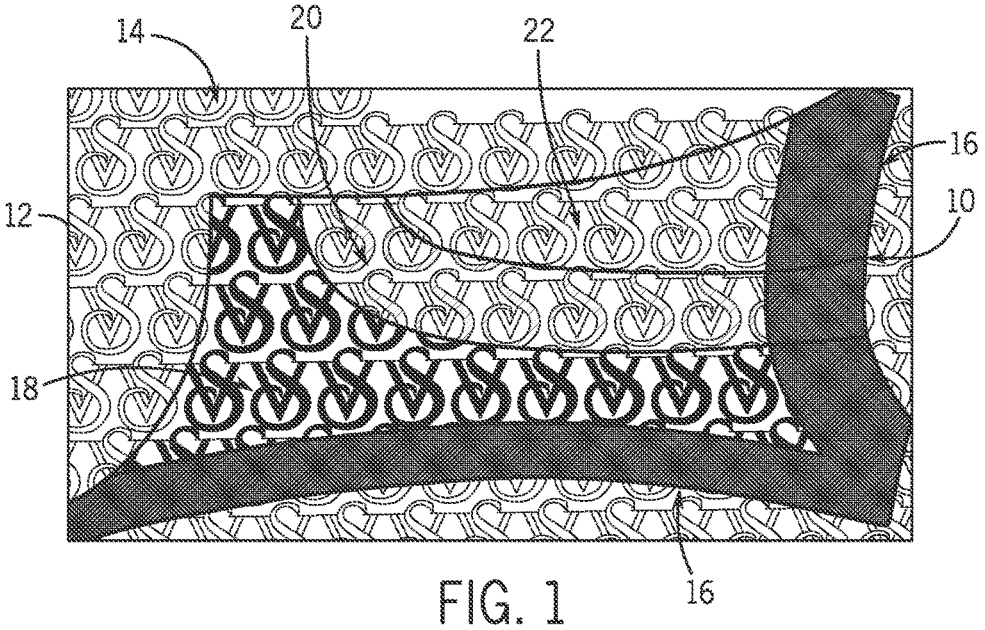
FIG. 1 illustrates one example of a fabric for forming a portion of a bra having zones with different elastic moduli according to the present disclosure.
Figure 2:
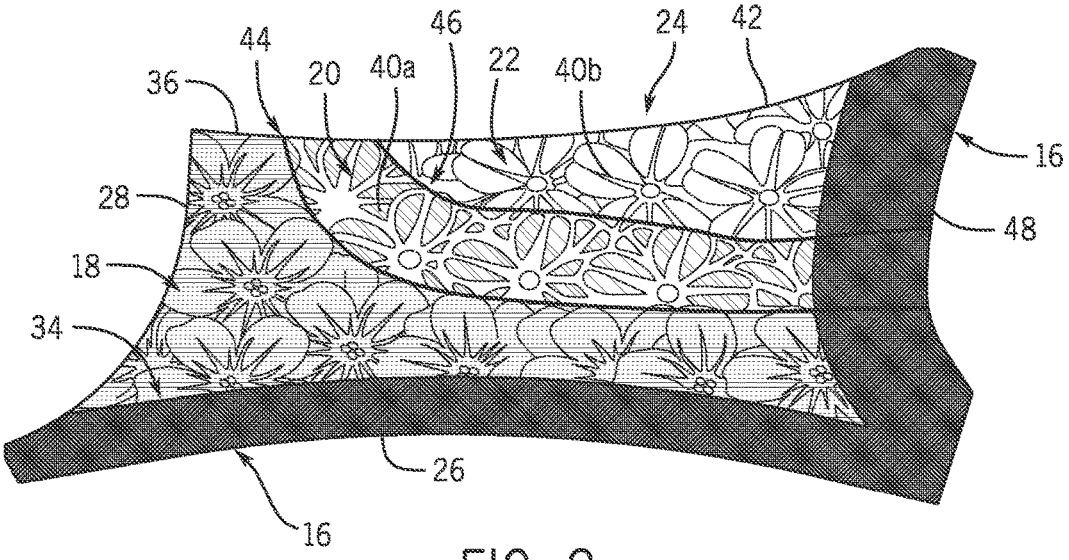
FIG. 2 illustrates an example in which the portion of the bra is a bra wing.

FIG. 1 illustrates a portion 10 of a bra that is to be cut out of a piece of fabric 12. As will be described herein below, the bra portion 10 is made of a fabric, such as a double-faced fabric, knit with a stretchable yarn that has a high elastic modulus, such as a polyurethane-based elastomer yarn. A silicone pattern 14 is printed on a first face of the fabric 12, which is the face that is shown in FIG. 1. The printed silicone pattern 14 in this example is a repeating pattern with the letters "V" and "S," but could be any other pattern, such as a flower pattern as shown in FIG. 2 or a different pattern providing a pleasing aesthetic. As will be described further herein below, the printed silicone pattern 14 at least partially penetrates the first face of the fabric 12 on which is printed.

As can be seen from examination of FIG. 1, the bra portion 10 includes a first zone 16 on the first face of the fabric 12 where the printed silicone pattern 14 has a first surface density. In this case, the first zone 16 is shown in solid black and extends along the bottom edge of the bra portion 10, as well as along the entire right edge of the bra portion 10. Although the pattern printed in the first zone 16 need not itself be solid black (nor solid printing in any other color), this shading is used to symbolize the relative surface density of the printed silicone pattern 14 in the first zone 16 versus the surface density of the printed silicone pattern 14 in the other zones about to be described.

For instance, the bra portion 10 also includes a second zone 18 on the first face of the fabric 12 where the printed silicone pattern 14 has a second surface density that is different than the first surface density. According to the present disclosure, the first surface density of the printed silicone pattern 14 imparts a first elastic modulus to the fabric of the bra portion 10 in the first zone 16, and the second surface density of the printed silicone pattern 14 imparts a second elastic modulus to the fabric of the bra portion 10 in the second zone 18 that is different than the first elastic modulus. In one example, the second surface density of the printed silicone pattern 14 in the second zone 18 is less than the first surface density of the printed silicone pattern 14 in the first zone 16. This is indicated by the darker shading (solid black) in zone 16 than the shading shown in zone 18. Again, the fact that zone 16 is filled in as a solid color does not necessarily mean that the printing here is solid; rather, such shading is used merely to show that the surface density of the printed silicone pattern 14 in the first zone 16 is greater than the surface density of the printed silicone pattern 14 in the second zone 18. For example, the actual pattern printed on the fabric 12 in the first zone 16 could be an even darker repeating "V" and "S" pattern than that shown in the second zone 18.

According to the characteristics of the silicone used to make the printed silicone pattern 14, the lesser surface density in the second zone 18 results in the fabric 12 in the second zone 18 having a second elastic modulus that is less than the first elastic modulus of the fabric 12 in the first zone 16. In one example, the first zone 16 may therefore be stiffer than the second zone 18. The first zone 16 also has less tendency to deform in response to application of an equal load, and a greater ability to restore itself to its original shape after it has been deformed, than does the second zone 18, as known to those having ordinary skill in the art familiar with the relationship between tensile force and change in length described by Hooke's law and Young's modulus of elasticity. As one example of a method that can be used to test or prove such different elastic moduli, the load values required to stretch a first piece of fabric having the first printed pattern and the first elastic modulus to a plurality of percentages of elongation may be greater at each elongation percentage in the plurality of percentages than the load values required to stretch a second piece of fabric, similar in all ways to the first, except that it has the second printed pattern and the second elastic modulus, to the same percentages of elongation. Fabric having the first elastic modulus due to the first printed silicone pattern may also exhibit a higher recovery, calculated as (elongated_length−recovered_ length)+(elongated_length−original_length), than fabric having the second elastic modulus due to the second printed silicone pattern. Such measurements can be made using a tensile testing machine provided by Instron® of Norwood, Mass.

According to the present disclosure, the bra portion 10 may further include an nth zone on the first face of the fabric 12 where the printed silicone pattern 14 has an nth surface density that is less than the second surface density, and the nth surface density imparts an nth elastic modulus to the fabric 12 of the bra portion 10 in the nth zone that is less than the second elastic modulus. For example, the number "n" can comprise any number between three and infinity. In the example shown, two additional nth zones are provided, such as a third zone 20 and a fourth zone 22. In the third zone 20, the surface density of the printed silicone pattern 14 is less than it is in the second zone 18, and the elastic modulus in the third zone 20 is less than it is in the second zone. Further, the printed silicone pattern 14 has a surface density in the fourth zone 22 that is less than the surface density of the printed silicone pattern 14 in the third zone 20, as well as an elastic modulus that is less than that in the third zone 20. This is exemplified by the increasingly lighter pattern of the repeating V's and S's in zones 20 and 22. In one example, the density of the silicone printing in each of the first through nth zones is non-zero, i.e., there is at least some amount of silicone printed in each of the first through nth zones.

As can be seen, the fabric 12 can be printed with the printed silicone pattern 14 outside of the boundaries of the bra portion 10 that is to be cut from the fabric 12. Alternatively, the bra portion 10 can be pre-cut from the fabric 12 and later printed with the printed silicone pattern 14. In the example shown, the silicone can be printed as the "V" and the "S" on an underlying cloth (shown as the blank white space behind the "V" and the "S"). In another example, the silicone pattern 14 can be printed on the white space, in which case the "V" and "S" would represent the cloth showing through from underneath the printed silicone pattern. In other words, the "V" and "S" pattern is not limiting on the scope of the present disclosure, the pattern itself need not be an actual recognizable pattern, and/or the printing could be done on negative space behind a different, perhaps recognizable, pattern.

As mentioned above, the fabric 12 may be a double-faced fabric, of which both sides of the fabric are considered "finished." According to one example of the present disclosure, the fabric 12 is a double knit fabric. As known to those having ordinary skill in the art, double knit fabrics are generally medium- to heavy-weight textiles that provide stability that a single knit fabric might otherwise not provide. Generally, double knit fabrics are somewhat dense and about twice the thickness of single knit fabrics, and therefore prevent an undesired amount of stretch and are less likely to curl at their edges. One benefit of this latter property will be described further herein below. In another example, the double-faced fabric is a thin, three-dimensional knitted spacer fabric having an inner face layer, an outer face layer, and a pile/connecting layer. In one example, the entire bra portion 10 is made of a single continuous piece of the double-faced fabric. This provides extra strength and stability to the bra portion 10, as well as eliminates the need to provide multiple seams between different areas of the bra portion 10 and/or between the different zones 16, 18, 20, 22, which seams might show through clothing. In another example, the bra portion 10 may include only one layer of the double-faced fabric. This, as will be discussed further below, reduces bulkiness of the bra portion 10 and provides a smooth and flat fit against a wearer's skin.

In one example, the double-faced fabric 12 comprises a polyurethane-based elastomer yarn, such as a thermoplastic polyurethane (TPU) polymer yarn or a polyurethane yarn (e.g., elastane). In another example, except for the inclusion of the printed silicone pattern 14, the double-faced fabric 12 is made of 60 percent of the polyurethane-based elastomer and 40 percent nylon. This can be provided by double knitting or spacer knitting polyurethane-based elastomer yarn and nylon yarn together. Of course, other percentages of the polyurethane-based elastomer and nylon would work, and each type of yarn can be provided as anywhere between 0% to 100% of the double-faced fabric, with amounts within ±30% of a 50:50 ratio being somewhat preferable, 55-65% polyurethane-based elastomer with 35-45% nylon being more preferable, and 60% of the polyurethane-based elastomer and 40% nylon being most preferable for the purposes of silicone printing. In one particular example, the fabric can be a double knit fabric made with 60% TPU polymer and 40% nylon. The TPU yarn can be 70 denier, although ranges of 20 denier to 140 denier would also work, while the nylon yarn can be 30 denier, although ranges of 10 denier to 160 denier would also work. In one example, the weight of the fabric is between around 360 grams per square meter (GSM) and about 390 GSM, ±5%. In another example, the bra portion may be knitted using yarn that is a TPU polymer-nylon blend.

In one example, the TPU polymer yarn may be an elastic fiber that has a relatively flat modulus curve at between 100% and 200% elongation. The elastic fiber is made from TPU polymers and is made by a melt-spinning process where the fiber is wound onto bobbins at a speed just slightly higher than the melt velocity of the polymer exiting the spinneret. The TPU polymer yarn is strong due to its high molecular weight for a given denier. The TPU polymer yarn therefore provides a good elastic modulus, which is needed during wearing. The TPU polymer yarn is thin and breathable. The TPU polymer yarn has high stretch because of its thermoplastic nature. Also, at higher (body) temperature, its elongation will be increased by about 10% to 20% over that at room temperature. Its stretchiness can react to the body's temperature to provide more comfort during wearing. In one example, the TPU polymer yarn is created according to the processes described in U.S. Patent Publication No. 2010/0325782 and/or U.S. Pat. Nos. 7,763,351 and 7,799,255, all assigned to Lubrizol Advanced Materials, Inc., of Cleveland, Ohio. Lubrizol sells an exemplary TPU polymer yarn under the trademark $X4_{ZOL}$™-J. Other TPU polymers or even other types of thermoplastic elastomers could be used for the fibers as well.

Fabric knitted at least in part from the TPU polymer yarn controls compression in 360° and in three dimensions (x-y-z), thereby providing comfort, shape, and support while allowing more freedom of movement. This three-dimensional nature allows fabric knitted from the TPU polymer yarn to balance stresses in order to allow freedom of movement. Fabric knitted from the TPU polymer yarn is easy to stretch in the x-y direction, so a bra made from the fabric is easy to put on and take off. Further, fabric made from the TPU polymer yarn provides compression in the z direction. This can help to hold the bra to the body more tightly. The TPU polymer yarn is also thinner, but stronger (still with good breathability) than normal elastic fiber.

The silicone used to provide the printed silicone pattern 14 may be specifically formulated such that when it is printed on and penetrates the first face of the fabric 12, it does not penetrate a second, opposite face of the fabric, except perhaps unintentionally. By the second, opposite face, it is meant the face of the fabric that is opposite that shown in FIG. 1. The second, opposite face is configured to face away from the wearer's body when the bra portion 10 is worn as part of a bra, while the first face shown in FIG. 1 is configured to contact a wearer's body when the bra portion 10 is worn as part of a bra. Because the printed silicone pattern 14 at least partially penetrates the first face of the fabric 12, but generally does not penetrate the second, opposite face of the fabric 12, the printed silicone pattern 14 is embedded at least partially inside the double-faced fabric. By way of example, the present inventors found through research and development that a double knit, 60% TPU polymer and 40% nylon fabric 12 having a weight between about 360-390 grams per square meter (GSM) used to make the bra portion 10 provides the right fiber type and weight to allow embedding of the silicone while still preventing penetration of the silicone to the fabric's opposite face. Additionally, although the printed silicone pattern may at least partially penetrate the first face, it can also remain somewhat on the surface of the first face as well, thereby giving the bra portion 10 the ability to provide a slight gripping effect on the wearer's body. Such penetration shall be such that the distribution ratio of the silicone is within about 90% to 100%, and there is between about 0% to 10% silicone on the surface of the fabric. However, a minimum 95% distribution ratio and a maximum of 5% on the surface of the fabric is preferred. In any case, the at least partial penetration of the silicone into the first face of the fabric ensures that the print is not as clingy or sticky as a traditional silicone print would be if the silicone were printed only on the surface of the fabric. See, for example, U.S. Patent Application Publication No. 2015/0111466, incorporated by reference above. Traditional silicone printing on the surface of a fabric only is visible and bulky and can effect the hand feel of a bra, which is commercially controversial for some wearers.

Some manufacturers have attempted to solve the hand feel and stickiness problem of traditional silicone printing on the surface of a garment by providing flock over the silicone on the surface of the fabric. See U.S. Patent Application Publication Nos. 2011/0083246, 2009/0271914, and 2010/0173119, and DE Patent No. 19942996, mentioned herein above. However, adding flock to the silicone printing results in the fabric having a "velvety" hand feel, as well as adds dimension to the fabric of the garment that could potentially show through on the second, opposite side of the fabric. Silicone flock printing additionally results in more bulkiness of the fabric, thus defeating the smoothing purpose of the bra portion 10 described herein. In general, traditional flock printing results in fabric that is more rigid, thicker, warmer to the touch and less breathable than the example fabrics described herein. Thus, traditional silicone flock printing does not fulfil the fit and comfort requirements that are desired across all garment sizes, and will not result in a garment that provides a smoothing effect.

Rather, according to the present disclosure, by adjusting the viscosity of the silicone used in the silicone printing and using a complementary blend of fibers and weight for the double-faced fabric, the silicone can be made to just penetrate into the first face of the fabric 12 without seeping out from the second, opposite side of the fabric 12. If any silicone does leak through to the second, opposite side of the fabric, this is likely unintentional. The penetration of the fabric by the silicone reduces the bulkiness of the fabric, as well as results in a less sticky/clingy feel, which therefore eliminates the need to provide flock to cover the stickiness. Meanwhile, preventing the silicone from seeping through to the second side means that the outer face of the bra (i.e. the face that does not contact the wearer's body) has a hand feel similar to that of a traditional fabric without silicone printing, and does not show the printed pattern, thereby maintaining a pleasing aesthetic. Methods for achieving the correct viscosity for the silicone and for printing it onto the fabric can be performed by MAS Holdings of Colombo, Sri Lanka. For particular examples of silicone printing techniques, please refer to PCT Application Publication WO2014/049390, assigned to MAS Research & Innovation (Private) Limited.

One particular use of the bra portion 10 can be to form a bra wing 24 as shown in FIG. 2. A smoothing effect can be achieved by the bra wing 24 when worn on a wearer's back by strategic printing of the printed silicone pattern 14, as will be described now. For example, referring also to FIG. 3 for purposes of orienting the bra wing 24 with respect to a bra 30, at least a part of the first zone 16 may be proximate a lower edge 26 of the bra wing 24. A remainder of the first zone 16 may be proximate a back edge 48 of the bra wing 24. A front edge 28 of the bra wing 24 is configured to be coupled to a bra cup 32, as will be described further herein below.

The second zone 18 may be situated proximate a lower-middle area of the bra wing 24. The first zone 16 may share a border with the second zone 18, as shown at 34. The second zone 18 may further extend up to a rear, upper edge 36 of the bra wing 24, where the bra wing 24 is configured to be coupled to the back end of a strap 38 of the bra 30.

The nth zone (such as the third zone 20 or the fourth zone 22) may be proximate an underarm area 40 of the bra wing 24. For example, the third zone 20 may be situated in a relatively lower underarm area 40*a*, while the fourth zone 22 may be situated in a relatively higher underarm area 40*b* that makes up a majority of the upper edge 42 of the bra wing 24. It can be seen from examining FIG. 2 that the second zone 18 shares a different border 44 with the nth zone (e.g. third zone 20) than it does with the first zone 16, as shown at 34. Further, it can be seen that the third zone 20 shares a different border 46 with the fourth zone 22 than the third zone 20 shares with the second zone 18, as shown at 44. In other words, in the example shown, the first, second, third, and fourth zones abut one another along borders 34, 44, 46. The borders 34, 44, 46 are shown as thick dark lines in order that they can be seen against the printed pattern shown on the bra wing 24, but in reality the borders 34, 44, 46 do not exist as such. Rather, any visible delineation between the zones is due only to a potentially visible change in the surface density of the printed silicone pattern 14. Note that in the example, the zones 16, 18, 20, 22 shown in FIG. 2 make up the entirety of the bra wing 24. In other examples, the zones need not directly abut one another at shared borders and/or need not make up the entirety of the bra portion 10, such as the bra wing 24. In other words, there could be zones on the bra portion 10 that have no silicone printing.

Figure 3:
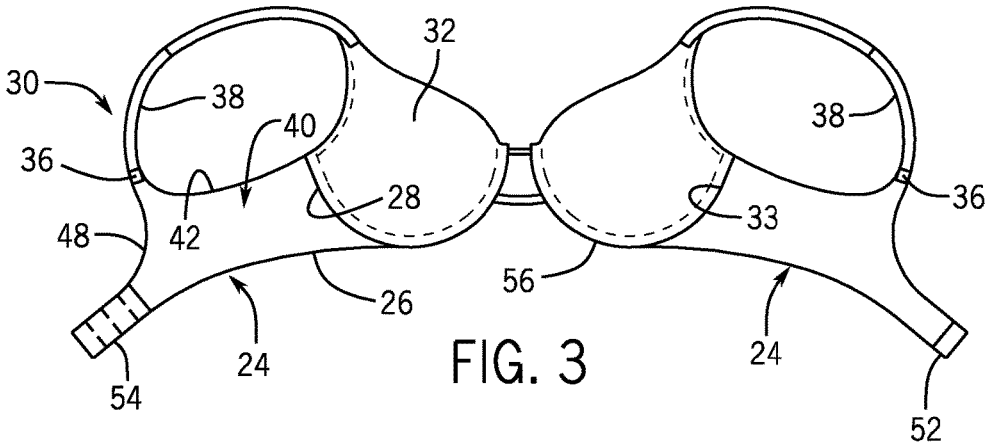
FIG. 3 illustrates a front view of a bra and provides reference for different areas of the bra that are discussed with respect to FIGS. 2, 4, and 5.

In one example, as shown in FIGS. 2 and 3, the lower edge 26 of the bra wing 24 comprises a raw edge that is free of an elastic band. That is, there is no elastic band glued, sewn, or otherwise bonded to the lower edge 26 of the bra wing 24, as there is in many prior art bras. This enhances the smoothness of the bra wing 24 when worn because it eliminates a tight fit around the wearer's torso where an elastic band would otherwise be. Prior art bras on the market that have one-layer fabric wings without an elastic band at the top or bottom generally only work for small bra sizes. For larger sizes, such as 36C and larger, manufacturers generally add an elastic band at the lower edge 26 of a bra wing to provide the level of support required for a larger wearer. Other manufacturers who have raw edges on both the upper 42 and lower 26 edges of the wing need to use a bone about half way between the front edge 28 of the bra wing 24 and the back edge 48 of the bra wing 24, in order to provide structural support and prevent the wing from folding over on itself or curling at the upper 42 and lower 26 edges. Other manufacturers that do not include elastic at the top or bottom edges of the wing have very wide and tall wings in order to prevent such rolling over, which are not aesthetically pleasing, especially if a wearer intends to wear the bra underneath a tank top or a shirt with a low cut back.

However, providing silicone printing having a different surface density in each of the different zones 16, 18, 20, 22 of the bra wing 24 as described with respect to the present disclosure allows the bra wing 24 to have different stretch and recovery properties in different zones. See also FIG. 4, where the bra wing 24 and above-mentioned zones 16, 18, 20, 22 are shown on a wearer 50. For example, the high surface density printing in the first zone 16, which creates a high elastic modulus, ensures that a relatively tight fit can be provided in the first zone 16, which can then serve the same function as a band of elastic would otherwise serve, and provides a good fit along the lower edge 26 and back edge 48 areas without digging into the wearer's skin. The denser amount of silicone printing in the first zone 16 provides an anchor to the wearer's body and the tension necessary to support the wearer's breasts. The first zone 16 provides this tight fit without rolling over, due to its stiffness as a result of both the double-faced construction of the fabric and the modulus created by the printed silicone pattern.

Figure 4:
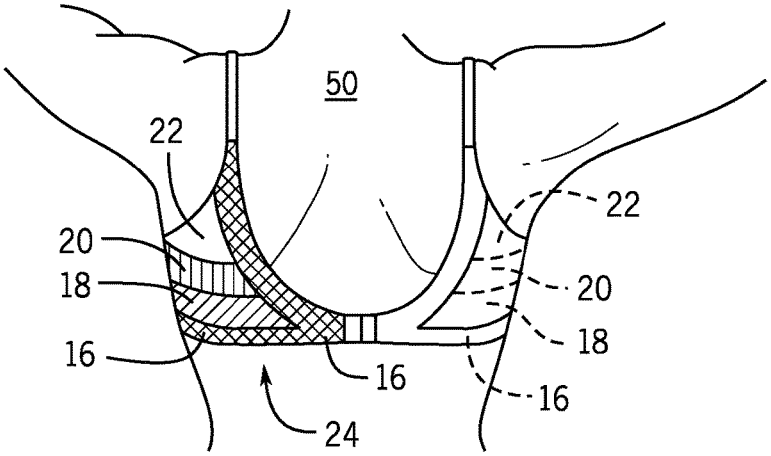
FIG. 4 illustrates a rear view of an example bra on a wearer.

Referring to FIGS. 2-4, as the surface density of the silicone printing decreases (i.e. as the zones change from 16 to 18 to 20 to 22), the tension around the wearer's body also decreases, and eventually provides a minimal amount of tension at the upper edge 42, which is directly beneath the wearer's underarm, and where skin is otherwise likely to bulge over a very tight wing or elastic band. The third and fourth zones 20, 22, having lower elastic moduli than the first and second zones 16, 18, stretch to conform to the wearer's body shape with no cutting or digging in, and therefore no lines show under the wearer's clothing. Of course, although components such as the elastic bands have been removed from the upper and lower edges 42, 26 of the bra wing 24, other components, such as for example a hook portion 52 and an eye portion 54 can be provided at the outer or back edges 48 of each bra wing 24. Alternatively, the bra 30 could be a front-close bra and the back portion could comprise two, permanently-connected bra wings 24 having the zones described herein, where the zones are arranged as mirror images of one another. Even in the case where the bra 30 is a back-close bra, the zones 16, 18, 20, 22 can be arranged in a mirror image of one another, as shown by the dashed lines on the right side of the bra in FIG. 4. (The zones are not shaded on the right side in the back view in order to provide clarity to the figure.) Additionally, as mentioned briefly above, areas 36 for connection of the bra wings 24 to straps 38 will also be provided, as is conventional.

As discussed, the present inventors have determined that using a double-faced fabric with a polyurethane-based elastomer yarn, for example a double knit fabric formed with nylon and a TPU polymer, such as the $X4_{ZOL}$™-J described herein above, allows the silicone to have enough room to penetrate into the fabric and to stay in the fabric without coming out the opposite side or washing off. From various tests of a bra including two bra wings manufactured as described herein, the present inventors have determined that the floral printed silicone pattern shown in FIG. 2 can be very effective at slimming a wearer's back when the surface density of the printed silicone pattern 14 is provided as shown in the following table. Note that a bra made with bra wings having the following silicone surface densities in roughly the same shaped zones as shown in FIG. 2 exhibited on average at least as much recovery as a typical elastic-band bra when new, and lost on average only about 1% of its recovery after ten washes, and only about 4% of its recovery after twenty-five washes. Additionally, the tested bra with bra wings made according to the present disclosure exhibited roughly similar load capacity when stretched as a typical elastic-band bra, depending on bra size.

| Zone | Silicone Density in GSM (Average) | Variation |
|---|---|---|
| 1 | 160 | +/−20 |
| 2 | 105 | +/−20 |
| 3 | 85 | +/−20 |
| 4 | 60 | +/−20 |

The "VS" pattern shown in FIG. 1 could be used for a different aesthetic, and similar surface densities of the silicone printing could be provided in order to achieve a similar effect as that of the tested floral pattern of FIG. 2. In fact, a multitude of patterns can be used as long as they fit with the resulting trend of having zones with different surface densities that create a gradual support system that varies from zone to zone.

Additionally, the concept of having different zones need not be applied using only one, two, three, or four zones. For instance, zones that have no defined borders (compare FIG. 2) could be used. The zones could gradually fade from one zone to the next, and could hypothetically be infinite in number. The zones also need not be bordered exactly as they are shown herein, but rather could comprise different shapes and/or sizes in order to achieve a particular effect, or in order to fit a particular bra portion to which they are applied.

Figure 5:
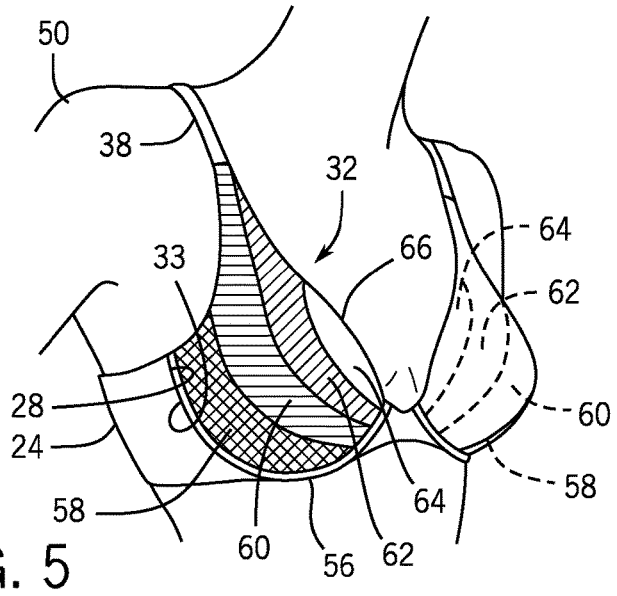
FIG. 5 illustrates a front perspective view of an example bra on a wearer.

Referring now to FIG. 5, an example in which the bra portion 10 is a bra cup 32 will be described. Bra cup 32 may be made of the double-faced fabric, and could in fact be made from the same, continuous piece of double-faced fabric as the bra wings 24 were made from. Alternatively, the bra cup 32 could be made from a separate piece of fabric that is sewn or otherwise bonded to the bra wing 24. In any case, the double-faced fabric of the bra cup 32 could be made of the same polyurethane-based elastomer and nylon yarns described above, which description applies equally to the fabric of the bra cup 32 but will not be repeated here. The bra cup 32 is coupled to the front edge 28 of the bra wing 24. The front edge 28 of the bra wing 24 therefore meets a laterally outer edge 33 of the bra cup 32.

The different zones of the bra cup 32 will be referred to as first, second, third, and fourth zones for ease of explanation. However, it should be understood that if both the bra wing 24 and the bra cup 32 of the same bra 30 were provided with zones of silicone printing, the zones on the bra cup 32 could be referred to as the n+1 through the n+x zones. If only a bra cup 32 is provided with zones having different surface densities of silicone printing, these zones could then be referred to as the first through nth zones. In other words, the numerical labeling of the zones on the bra wing 24 and bra cup 32 is not limiting on the scope of the present disclosure. Further, although the zones of the bra cup 32 will be referred to as the first through fourth zones, it should be understood that these zones need not be provided with the same surface density of printing as the first through fourth zones of the bra wing 24. Rather, the elastic modulus of each zone in the bra cup 32 could be different than the elastic modulus of each zone in the bra wing 24, and the differential between each of the elastic moduli in each zone could be different as well.

The bra cup 32 comprises a first zone 58 on the first face of the fabric, proximate a laterally outer edge 33 and a lower edge 56 of the bra cup 32. The printed silicone pattern in this first zone 58 may have a first surface density that imparts a first elastic modulus to the fabric of the bra cup 32 in the first zone 58. Additionally, a second zone 60 may be provided on the first face of the fabric proximate a laterally middle area of the bra cup 32, where the printed silicone pattern has a second surface density that imparts a second elastic modulus to the bra cup 32 in the second zone 60. In one example, the second surface density of the printed silicone pattern is less than the first surface density of the printed silicone pattern, and the second elastic modulus is less than the first elastic modulus. The bra cup 32 may further comprise a third zone 62 and a fourth zone 64, each having progressively decreasing surface densities of the printed silicone pattern, as well as progressively decreasing elastic moduli. This pattern of decreasing elastic moduli as the fabric of the bra cup 32 progresses from the laterally outer edge 33 towards the laterally inner edge 66 of the bra cup 32 can provide a higher density and elastic modulus at the bottom of the bra cup 32 where the breast needs the most support. This area can optionally be provided with an underwire in a tunnel casing, as is known. The density and modulus will then gradually diminish to minimal amounts at the inner edge 66 of the bra cup 32, which is near the wearer's neckline. At the neckline, the raw inner edge 66 will be the least bulky and will thus provide a minimal change in surface contour underneath a wearer's clothes, thereby eliminating the ridge often seen through a wearer's shirt at the top edge of a bra cup.

As shown, the second zone 60 can extend from the inner part of the lower edge 56 of the bra cup 32 all the way up to the connection to the strap 38. This ensures that a portion of the bra cup 32 having a relatively high elastic modulus is connected to the strap 38, where the weight of the breast is carried by the strap 38 over the shoulder. Other configurations for the zones of the bra cup 32 and their abutting borders could be used and still fall within the scope of the present disclosure. Additionally, as with the bra wing 24, zones without any silicone printing can be provided. It should also be noted that the right bra cup shown in FIG. 5 can be provided with a mirror image of the same zones 58, 60, 62, 64, as shown in dashed lines. Note that although the zones are drawn on what has heretofore been referred to as the second face of the fabric of the bra cup 32 (the surface that faces away from the wearer's body), the printed silicone pattern is in fact provided on the first face of the fabric of the bra cup 32 that touches the wearer's skin. However, the second face is shown here for purposes of illustrating where the zones provide different levels of support when the bra cup 32 is worn as part of a bra 30 by a wearer 50.

It is known to treat fabric with silicone polymers for many reasons, such as, for example, to provide a water repellant yet breathable fabric. See, for example, WO 1989/008553; WO 1999/046118; and WO 2001/056710. However, the WO '553 and WO '710 publications do not discuss purposefully varying the modulus of a fabric using a silicone coating, nor do they discuss the use of silicone printing in particular patterns and/or densities to create zones of varying modulus. Although WO '118 does show application of a silicone coating to fabric in a pattern, it does not discuss how this technique can be used to create zones of varying modulus either. WO2014/049390 discloses coating a fabric with an elastomeric substance, such as silicone, to provide designed localized elastic modulus enhancements. However, WO '390 discloses merely coated and non-coated areas, and does not disclose creating several different zones of the fabric that have different elastic moduli due to application of silicone in different densities, thereby providing desired fits at particular areas of a garment.

Notably, the presently-described technology of creating different zones on a portion of a bra, which zones have different elastic moduli due to provision of different surface densities of silicone printing, provides an advance over prior art silicone coating techniques. For example, the presently-described technology can be used for any type of bra where a mix of strong tension but little pressure is required for part of the bra, not just those mentioned above with respect to FIGS. 4 and 5. For example, the silicone printing technique described herein can be applied to the bra strap 38, to the hook and eye 52, 54 portions of the bra 30, etc. Different percentages of silicone and different printing patterns can be combined so as to provide a best fit for any of these areas on a bra. The printed silicone pattern technology can also be used to provide support, nipple coverage (such as if a high elastic modulus is provided by a high surface density of printing at the apex of the bra cup 32), and different moduli at different areas of the wearer's body, while at the same time remaining smoothing, light, and breathable. Thus, when a bra portion is mentioned herein, this could refer to an entire bra, or to a part of piece of a bra such as a bra wing, bra cup, bra strap, etc. The type of bra and the size and shape of the bra portion, as well as whether the bra portion makes up an otherwise separately-definable part of a bra, are not limiting on the scope of the present disclosure, except as defined by the claims.

Using polyurethane-based elastomer yarn, such as TPU polymer yarn, provides both smoothing as discussed herein above with respect to elasticity, as well as good elongation and modulus. Fabric made with the TPU polymer yarn also has a higher heat capacity than traditional fabrics, such as those made with spandex, which provides the bra with good cooling power. Allowing the silicone to at least partially penetrate one face of the double-faced polyurethane-based elastomer and nylon fabric can provide the functionality and benefits of silicone's and spandex's properties, without the sticky surface and hand feel generally associated with silicone and spandex, and without adding thickness to the base raw material of the double-faced fabric. The silicone printing can be engineered to include a calculated percentage of silicone, which is used to provide different moduli at different parts of the bra portion. This helps to achieve a smooth back look when the bra portion is a bra wing 24 or both breast support and a smooth neckline when the bra portion is a bra cup 32. The bra portion 10 uses as few layers, as little construction, and as little thickness as possible, while still protecting the performance of the bra portion as a key functional part of the bra of which it is a part. The double-faced fabric with silicone printing is breathable and cool, and allows a single layer of continuous fabric with a cut raw edge and without additional support, such as an elastic band or a bone, to provide good fit, support, and comfort, especially in larger bra sizes.

In the above description certain terms have been used for brevity, clarity, and understanding. No unnecessary limitations are to be inferred therefrom beyond the requirement of the prior art because such terms are used for descriptive purposes and are intended to be broadly construed. The different articles of manufacture and methods described herein above may be used in alone or in combination with other articles of manufacture and methods.

What is claimed is:

1. A portion of a bra comprising:

a double-faced fabric made with a polyurethane-based elastomer yarn;

a silicone pattern printed on a first face of the fabric, the printed silicone pattern at least partially penetrating the first face of the fabric on which it is printed; and a first zone on the first face of the fabric where the printed silicone pattern has a first surface density, a second zone on the first face of the fabric where the printed silicone pattern has a second surface density that is different than the first surface density, and a third zone on the first face of the fabric where the printed silicone pattern has a third surface density that is less than the second surface density;

wherein the first surface density of the printed silicone pattern imparts a first elastic modulus to the fabric in the first zone, the second surface density of the printed silicone pattern imparts a second elastic modulus to the fabric in the second zone that is different than the first elastic modulus, and the third surface density of the printed silicone pattern imparts a third elastic modulus to the fabric in the third zone that is less than the second elastic modulus;

wherein the first zone shares a border with the second zone, and the second zone shares a different border with the third zone; and wherein the bra portion is either:

(a) a bra wing made of the double-faced fabric, and at least a part of the first zone is proximate a lower edge of the bra wing, the second zone is proximate a lower-middle area of the bra wing, and the third zone is proximate an underarm area of the bra wing; or (b) a bra cup made of the double-faced fabric, and the first zone is proximate a laterally outer edge and a lower edge of the bra cup, the second zone is proximate a laterally middle area of the bra cup, and the third zone is proximate a laterally inner edge of the bra cup.

2. The bra portion of claim 1, wherein the printed silicone pattern does not penetrate a second, opposite face of the fabric.

3. The bra portion of claim 2, wherein the first face of the fabric is configured to contact a wearer's body and the second face of the fabric is configured to face away from the wearer's body when the bra portion is worn as part of a bra.

4. The bra portion of claim 2, wherein the double-faced fabric is a double knit fabric and the polyurethane-based elastomer of the yarn is a thermoplastic polyurethane.

5. The bra portion of claim 4, wherein the second surface density of the printed silicone pattern is less than the first surface density of the printed silicone pattern and the second elastic modulus is less than the first elastic modulus.

6. The bra portion of claim 1, wherein the bra portion is the bra wing, and the lower edge of the bra wing comprises a raw edge that is free of an elastic band.

7. The bra portion of claim 1, wherein the entire bra portion is made of a single continuous piece of the double-faced fabric.

8. The bra portion of claim 7, wherein the bra portion comprises one layer only of the double-faced fabric.

9. The bra portion of claim 8, wherein except for inclusion of the printed silicone pattern, the double-faced fabric is made of between 55-65% polyurethane-based elastomer and between 35-45% nylon.

10. A bra comprising:

a bra wing made of a double-faced fabric;

a silicone pattern printed on a first face of the fabric, the printed silicone pattern at least partially penetrating the first face of the fabric on which it is printed;

a first zone on the first face of the fabric where the printed silicone pattern has a first surface density, at least a part of the first zone being proximate a lower edge of the bra wing; and a second zone on the first face of the fabric where the printed silicone pattern has a second surface density that is different than the first surface density, the second zone sharing a border with the first zone and being proximate a lower-middle area of the bra wing;

a third zone on the first face of the fabric where the printed silicone pattern has a third surface density that is less than the second surface density, the second zone sharing a different border with the third zone, and the third zone being proximate an underarm area of the bra wing;

wherein the first surface density of the printed silicone pattern imparts a first elastic modulus to the fabric of the bra wing in the first zone, the second surface density of the printed silicone pattern imparts a second elastic modulus to the fabric of the bra wing in the second zone that is different than the first elastic modulus, and the third surface density of the printed silicone pattern imparts a third elastic modulus to the fabric of the bra wing in the third zone that is less than the second elastic modulus.

11. The bra of claim 10, wherein the printed silicone pattern does not penetrate a second, opposite face of the fabric.

12. The bra of claim 11, wherein the first face of the fabric is configured to contact a wearer's body and the second face of the fabric is configured to face away from the wearer's body when the bra is worn.

13. The bra of claim 12, wherein the second surface density of the printed silicone pattern is less than the first surface density of the printed silicone pattern and the second elastic modulus is less than the first elastic modulus.

14. The bra of claim 12, further comprising:

a bra cup made of the double-faced fabric and coupled to a front edge of the bra wing;

a fourth zone on the first face of the fabric proximate a laterally outer edge and a lower edge of the bra cup, where the printed silicone pattern has a fourth surface density that imparts a fourth elastic modulus to the fabric of the bra cup in the fourth zone;

a fifth zone on the first face of the fabric proximate a laterally middle area of the bra cup, where the printed silicone pattern has a fifth surface density that imparts a fifth elastic modulus to the fabric of the bra cup in the fifth zone; and a sixth zone on the first face of the fabric proximate a laterally inner edge of the bra cup, where the printed silicone pattern has a sixth surface density that imparts a sixth elastic modulus to the fabric of the bra cup in the sixth zone;

wherein the fifth surface density of the printed silicone pattern is less than the fourth surface density of the printed silicone pattern and the fifth elastic modulus is less than the fourth elastic modulus; and wherein the sixth surface density of the printed silicone pattern is less than the fifth surface density of the printed silicone pattern and the sixth elastic modulus is less than the fifth elastic modulus.

15. The bra of claim 10, wherein the entire bra wing is made of one layer only of a single continuous piece of the double-faced fabric.

16. The bra of claim 15, wherein except for inclusion of the printed silicone pattern, the double-faced fabric is made of between 55-65% polyurethane-based elastomer and between 35-45% nylon.

* * * * *